US010637133B2

(12) United States Patent
Lu et al.

(10) Patent No.: US 10,637,133 B2
(45) Date of Patent: Apr. 28, 2020

(54) ANTENNA STRUCTURE, DRIVING METHOD THEREOF, AND ANTENNA SYSTEM

(71) Applicant: BOE TECHNOLOGY GROUP CO., LTD., Beijing (CN)

(72) Inventors: Yongchun Lu, Beijing (CN); Xinyin Wu, Beijing (CN); Hui Li, Beijing (CN); Yuxin Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 293 days.

(21) Appl. No.: 15/864,316

(22) Filed: Jan. 8, 2018

(65) Prior Publication Data

US 2018/0294557 A1 Oct. 11, 2018

(30) Foreign Application Priority Data

Apr. 6, 2017 (CN) ..... 2017 1 0221593

(51) Int. Cl.

| | |
|---|---|
| ***H01Q 1/36*** | (2006.01) |
| ***H01Q 1/40*** | (2006.01) |
| ***H01Q 3/44*** | (2006.01) |
| ***H01Q 19/06*** | (2006.01) |
| ***H01Q 1/38*** | (2006.01) |

(52) U.S. Cl.

CPC ..... *H01Q 1/36* (2013.01); *H01Q 1/38* (2013.01); *H01Q 1/405* (2013.01); *H01Q 3/44* (2013.01); *H01Q 19/067* (2013.01)

(58) Field of Classification Search

CPC .. H01Q 1/36; H01Q 1/38; H01Q 1/40; H01Q 1/405; H01Q 3/44; H01Q 19/067

See application file for complete search history.

(56) References Cited

U.S. PATENT DOCUMENTS

| | | | | |
|---|---|---|---|---|
| 6,002,456 | A * | 12/1999 | Togawa | G02F 1/13334 349/32 |
| 6,297,777 | B1 * | 10/2001 | Tsubaki | H01Q 1/243 343/700 MS |
| 9,647,001 | B2 * | 5/2017 | Li | H01L 27/124 |
| 2018/0102382 | A1 * | 4/2018 | Peng | G02F 1/1368 |

* cited by examiner

*Primary Examiner* — Dao L Phan

(74) *Attorney, Agent, or Firm* — Collard & Roe, P.C.

(57) ABSTRACT

Provided are an antenna structure, driving method thereof, and antenna system. The antenna structure includes a first base substrate, a second base substrate, a dielectric layer disposed between the first base substrate and the second base substrate, a plurality of first electrodes, and a plurality of second electrodes. The plurality of first electrodes are disposed apart at a side of the first base substrate facing to the dielectric layer, the plurality of second electrodes are disposed apart at a side of the second base substrate facing to the dielectric layer. The first base substrate includes a plurality of first micro-hole units, each of the first micro-hole units is disposed in a region between the adjacent first electrodes, each of the first micro-hole units includes at least one micro-hole extending a direction perpendicular to the first base substrate.

20 Claims, 4 Drawing Sheets

ANTENNA STRUCTURE, DRIVING METHOD THEREOF, AND ANTENNA SYSTEM

CROSS REFERENCE TO RELATED APPLICATIONS

Applicant claims priority under 35 U.S.C. § 119 of Chinese Application No. CN 201710221593.8 filed on Apr. 6, 2017, the disclosure of which is incorporated by reference.

TECHNICAL FIELD

Embodiments of the present disclosure relate to an antenna structure, a driving method thereof, and an antenna system.

BACKGROUND

With the continuous development of communication technology, antenna has gradually developed in the technical directions such as miniaturization, wide frequency band, various wave band, and high gain. Compared with the conventional horn antenna, helical antenna, and dipole antenna, liquid crystal antenna is a kind of antenna which is more suitable for the current technical development directions.

Generally, a liquid crystal antenna includes a transmitting patch, a grounded electrode and liquid crystal located between the transmitting patch and the grounded electrode. When electromagnetic wave of a specific frequency is transmitted to the liquid crystal antenna, the electromagnetic wave of the specific frequency can be radiated by the liquid crystal antenna if the specific frequency is in accordance with the resonant frequency of the liquid crystal, while the electromagnetic wave of the specific frequency cannot be radiated through the liquid crystal antenna if the specific frequency is not in accordance with the resonant frequency of the liquid crystal. Besides, because a variation of orientation of the liquid crystal will result in different effective dielectric constants and thus a variation of the capacitance, the orientation of liquid crystal between the transmitting patch and the grounded electrode can be adjusted by the voltage applied on the transmitting patch, so as to adjust the resonant frequency of the liquid crystal antenna.

SUMMARY

At least one embodiment of the present disclosure provides an antenna structure, driving method thereof, and antenna system. The antenna structure can provide a new type of antenna structure, which can effectively receive or transmit electromagnetic wave in a relatively wide frequency band, reduce main lobe width of electromagnetic wave, and make the electromagnetic wave have better directivity and more sensitive.

For example, at least one embodiment of the present disclosure provides an antenna structure, comprising: a first base substrate; a second base substrate; a dielectric layer, disposed between the first base substrate and the second base substrate; a plurality of first electrodes, disposed apart at a side of the first base substrate facing to the dielectric layer; and a plurality of second electrodes, disposed apart at a side of the second base substrate facing to the dielectric layer, wherein the first base substrate comprises a plurality of first micro-hole units, each of the first micro-hole units is located in a region between the adjacent first electrodes, and each of the first micro-hole units comprises at least one micro-hole extending along a direction perpendicular to the first base substrate.

For example, in the antenna structure provided by an embodiment of the present disclosure, the second electrodes and the first micro-hole units are in one-to-one correspondence, the first micro-hole units are disposed in an array on the first base substrate.

For example, in the antenna structure provided by an embodiment of the present disclosure, the micro-hole runs through the first base substrate.

For example, in the antenna structure provided by an embodiment of the present disclosure, orthographic projections of the first electrodes on the first base substrate and orthographic projections of the second electrodes on the first base substrate are alternately disposed.

For example, in the antenna structure provided by an embodiment of the present disclosure, the first base substrate comprises: a body portion, disposed parallel to the second base substrate; and an extending portion, disposed at an edge of the body portion and extending towards the second base substrate and contacting the second base substrate, wherein the extending portion comprises a second micro-hole unit, each of the second micro-hole unit comprises at least one micro-hole running through the extending portion.

For example, in the antenna structure provided by an embodiment of the present disclosure, the antenna structure further comprises: a control electrode, disposed between the plurality of first electrodes and the first base substrate, wherein the at least one micro-hole contacts the control electrode.

For example, in the antenna structure provided by an embodiment of the present disclosure, the dielectric layer comprises liquid crystal.

For example, in the antenna structure provided by an embodiment of the present disclosure, the liquid crystal comprises a dual-frequency liquid crystal material.

For example, in the antenna structure provided by an embodiment of the present disclosure, the antenna structure further comprises: barriers, disposed between the first base substrate and the second base substrate and located in a region between the adjacent second electrodes.

For example, in the antenna structure provided by an embodiment of the present disclosure, the barriers and the first electrodes are in one-to-one correspondence.

At least one embodiment of the present disclosure further provides a driving method of an antenna structure, the antenna structure comprises any one of the abovementioned antenna structures, the driving method comprises: obtaining a first holographic antenna pattern according to a first preset direction and a first preset frequency of electromagnetic wave to be received or transmitted; applying a same first driving voltage to the first electrodes; and applying a second driving voltage to a part of the second electrodes to change a dielectric constant of the dielectric layer at a position where the second electrodes applied with the second driving voltage are located to form the first antenna pattern.

For example, in the driving method of an antenna structure provided by an embodiment of the present disclosure, the driving method further comprises: obtaining a second holographic antenna pattern according to a second preset direction and a second preset frequency of electromagnetic wave to be received or transmitted; stop applying the second driving voltage; and applying a third driving voltage to a part of the second electrodes to change the dielectric constant of the dielectric layer at a position where the second electrodes applied with the second driving voltage are located to form the second antenna pattern.

For example, in the driving method of an antenna structure provided by an embodiment of the present disclosure, the first driving voltage comprises a driving voltage with low frequency, the second driving voltage and the third driving voltage are driving voltages with high frequency.

At least one embodiment of the present disclosure further provides an antenna system, which comprises any one of the abovementioned antenna structures.

For example, in the antenna system provided by an embodiment of the present disclosure, the antenna system further comprises: a control circuit, electrically connected with the first electrodes and the second electrodes to control the antenna structure, wherein the antenna structure comprises a plurality of antenna regions, the control circuit comprises: a plurality of signal receiving-transmitting circuits, connected with the first electrodes and the second electrodes in the plurality of antenna regions respectively; and a plurality of holographic antenna pattern calculation units, connected with the plurality of signal receiving-transmitting circuits respectively.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure, not limitative to the present disclosure.

DETAILED DESCRIPTION

Figure 1:
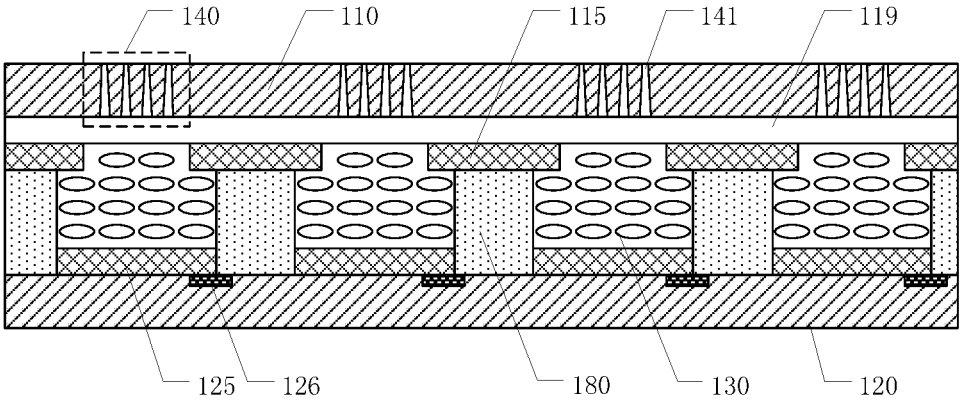
FIG. 1 is a structural schematic diagram of an antenna structure provided by an embodiment of the present disclosure.

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the disclosure. Based on the described embodiments herein, one person skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," and so on which are used in the description and the claims of the present application, are not intended to indicate any sequence, amount or importance, but distinguish various components. The terms "includes," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

In study, the inventors of the present application found that: the dielectric constant of liquid crystal has anisotropy. Thus, liquid crystal can serve as a dielectric tunable material, and the dielectric constant of liquid crystal can be changed by deflecting the liquid crystal molecules upon applied an electric field. Besides, compared with the common dielectric tunable materials such as ferrite and PIN transistor, liquid crystal has the advantages such as low operating voltage, low power consumption, low costs and is suitable for high-frequency and miniaturized electromagnetic devices. Therefore, liquid crystal would greatly expedite the improvement of the performance of phased array radar and satellite communication system. At another aspect, common antenna structures have a relatively large size, relatively narrow frequency band, and less waveband, and cannot satisfy the various requirements on antenna in the current market.

Embodiments of the present disclosure provide an antenna structure, driving method thereof, and antenna system. The antenna structure includes a first base substrate, a second base substrate, a dielectric layer disposed between the first base substrate and the second base substrate, a plurality of first electrodes, and a plurality of second electrodes. The plurality of first electrodes are disposed apart at a side of the first base substrate facing to the dielectric layer, the plurality of second electrodes are disposed apart at a side of the second base substrate facing to the dielectric layer. The first base substrate includes a plurality of first micro-hole units, each of the first micro-hole units is disposed in a region between the adjacent first electrodes, and each of the first micro-hole units includes at least one micro-hole extending a direction perpendicular to the first base substrate. Thus, the antenna structure is a new type of antenna structure capable of efficiently receiving or transmitting electromagnetic wave in a relatively wide frequency band, reducing main lobe width of electromagnetic wave, and making the electromagnetic wave have better directivity and more sensitive. Besides, the antenna is smaller in volume, lighter in weight, and simpler in manufacturing processes.

Hereafter, the antenna structure, the driving method thereof and the antenna system provided by the embodiments of the present disclosure will be described with reference to the accompanying drawings.

First Embodiment

The present embodiment provides an antenna structure. FIG. 1 illustrates an antenna structure provided by the present embodiment. As illustrated by FIG. 1, the antenna structure includes a first base substrate 110, a second base substrate 120, a dielectric layer 130, a plurality of first electrodes 115 and a plurality of second electrodes 125. The dielectric layer 130 is disposed between the first base substrate 110 and the second base substrate 120, the plurality of first electrodes 115 are disposed apart at a side of the first base substrate 110 facing to the dielectric layer 130, the plurality of second electrodes 125 are disposed apart at a side of the second base substrate 120 facing to the dielectric layer 130. The first base substrate 110 includes a plurality of first micro-hole units 140, each of the first micro-hole units 140 is disposed in a region between the adjacent first electrodes 115 and includes at least one micro-hole 141 extending along a direction perpendicular to the first base substrate 110.

In the antenna structure provided by the present embodiment, two adjacent first electrodes and the second electrode between the two adjacent first electrodes can be used to adjust the dielectric constant of the dielectric layer (for example, liquid crystal) located at the position where the second electrode is located, so as to form a resonant cavity unit with the dielectric layer located at the position where the second electrode is located. Besides, the resonant frequency of the resonant cavity unit can be controlled by applying a voltage or not to the second electrode, so as to realize turning on/off the electromagnetic wave transmission of the resonant cavity unit. That is, the resonant cavity unit formed by the two adjacent first electrodes, the second electrode located between the two adjacent first electrodes, and the dielectric layer located at the position where the second electrode is located is equivalent to an electromagnetic wave micro switch. Besides, the resonant frequency of the resonant cavity unit can be adjusted by adjusting the magnitude of the voltage applied on the first electrode and the second electrode in the resonant cavity unit. In this way, the antenna structure can receive or transmit electromagnetic wave in a relatively wide frequency band.

In the antenna structure provided by the present embodiment, the first micro-hole unit disposed in the region between two adjacent first electrodes can play a role of effectively gathering electromagnetic wave, reducing main lobe width of electromagnetic wave. Thus, the antenna structure can make the electromagnetic wave have better directivity and more sensitive. That is, in a designated direction, the antenna structure has a stronger and more precise ability of receiving and transmitting electromagnetic wave. In addition, compared with the first micro-hole unit formed by a metal material, the antenna structure provided by the present embodiment with the first micro-hole unit disposed in the first base substrate, is higher in focusing precision, smaller in volume is, lighter in weight, and simpler in manufacturing process.

In the antenna structure provided by the present embodiment, the second electrodes can be independently controlled. When the antenna structure is operating, each resonant cavity unit can serve as an antenna unit which can independently receive or transmit electromagnetic wave. That is, the plurality of resonant cavity units can form a resonant cavity unit array or an antenna unit array. In this way, the resonant cavity unit array or the antenna unit array can transmit or receive electromagnetic wave in any direction forming an angle of positive or minus 90 degrees with respect to an aiming line of the resonant cavity unit array or the antenna unit array, according to a destructive and constructive interference principle. That is, by turning on or off different resonant cavity units or antenna units, different modes of constructive interference and destructive interference can be produced, so as to transmit or receive electromagnetic wave in directions which form different angles with the aiming line of the resonant cavity unit array or the antenna unit array. Moreover, the antenna structure can sequentially receive or transmit electromagnetic wave in different directions by switching between different modes of constructive interference and destructive interference. It is noted that, the abovementioned aiming line is located in the center of the antenna structure and perpendicular to the center of the antenna structure.

For example, in the antenna structure provided by an example of the present embodiment, as illustrated by FIG. 1, the orthographic projections of the plurality of first electrodes 115 and the plurality of second electrodes 125 on the first base substrate 110 are alternately disposed. An electric field formed by the first electrodes and the second electrodes is not perpendicular to the first base substrate, but forms an angle with the first base substrate. In this way, the thickness of the dielectric layer can be reduced in the premise of guaranteeing the resonance effect of the resonant cavity unit.

For example, in the antenna structure provided by an example of the present embodiment, as illustrated by FIG. 1, the micro-hole 141 runs through the first base substrate 110, thus avoiding that a micro-hole without penetrating the first base substrate from blocking the electromagnetic wave, so as to reduce the loss of the electromagnetic wave.

For example, in the antenna structure provided by an example of the present embodiment, as illustrated by FIG. 1, the antenna structure further include a plurality of driving elements 126, disposed at a side of the second base substrate 120 facing to the dielectric layer 130, the plurality of second electrodes 125 are electrically connected with different driving elements 126 respectively. In this way, the plurality of second electrodes 125 can be controlled by the plurality of driving elements 126 respectively. For example, the driving element can include a thin film transistor. It is noted that, the plurality of first electrodes can be independently controlled, or controlled together, which is not limited herein.

Figure 2:
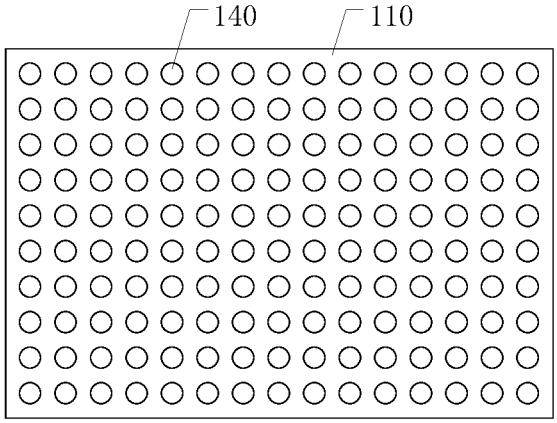
FIG. 2 is a plan view of an antenna structure provided by an embodiment of the present disclosure.

For example, in the antenna structure provided by an example of the present embodiment, as illustrated by FIG. 1, the plurality of second electrodes and the plurality of first micro-hole units 140 are in one-to-one correspondence. FIG. 2 illustrated a plan view of an antenna structure provided by the present embodiment. As illustrated by FIG. 2, the plurality of first micro-hole units 140 is disposed in an array on the first base substrate 110. Thus, the plurality of resonant cavity units including the plurality of first micro-hole units can form a resonant cavity unit array or an antenna unit array. The resonant cavity unit array or the antenna unit array can transmit or receive electromagnetic wave in any direction forming an angle of positive or minus 90 degrees with respect to an aiming line of the resonant cavity unit array or the antenna unit array, according to a destructive and constructive interference principle.

For example, in the antenna structure provided by an example of the present embodiment, as illustrated by FIG. 1, an orthographic projection of the first micro-hole unit 140 on the first base substrate 110 falls into an orthographic projection of the second electrode 125 on the first base substrate 110. In this way, the second electrode can better control the liquid crystal at the position where the first micro-hole unit is located, so as to guarantee a relatively good resonant effect.

For example, in the antenna structure provided by an example of the present embodiment, a shape of a cross-section of the micro-hole includes at least one selected from a group consisting of circle shape, rectangle shape, and triangle shape. Certainly, the embodiments of the present disclosure include but are not limited thereto, the shape of the cross-section of the micro-hole can be other shapes.

For example, in the antenna structure provided by an example of the present embodiment, the dielectric layer can include liquid crystal. Because the response speed of liquid crystal is relatively fast (for example, in millisecond), the antenna structure employing liquid crystal as the dielectric layer has a faster response speed and switching speed. Besides, in a case where the antenna structure provided by the present embodiment is applied to conduct scanning, i.e., transmitting or receiving electromagnetic wave in various directions, compared with the antenna structure using a mechanic structure to scan, the antenna structure provided by the present embodiment does not need a rotating device with a big volume and heavy weight, can realize lighting and thinning the antenna structure, and does not affect the fast scanning to the electromagnetic wave signals of the antenna structure at the same time.

For example, in the antenna structure provided by an example of the present embodiment, the liquid crystal includes a dual-frequency liquid crystal material. Because the dual-frequency liquid crystal material (positive liquid crystal, negative liquid crystal) has a critical voltage frequency value, the response time of the on-off of the dual-frequency liquid crystal material can reach a microsecond class. Therefore, the response speed and scanning speed of the antenna structure can be further improved.

For example, in the antenna structure provided by an example of the present embodiment, as illustrated by FIG. 1, the antenna structure further includes: a control electrode 119 disposed between the plurality of first electrodes 115 and the first base substrate 110 and covering an entire surface of the first base substrate 110. For example, the control electrode 119 is plate-shaped and covers all of the micro-holes 141 in the first base substrate 110. In this way, the control electrode 119 can be used to apply an electric signal to the first electrode 115. Certainly, the embodiments of the present disclosure include but are not limited thereto, each of the first electrodes can be connected with a lead wire, so as to apply an electric signal to the first electrode through the lead wire.

For example, in the antenna structure provided by an example of the present embodiment, as illustrated by FIG. 1, each of the micro-hole 141 contacts the control electrode 119, so as to improve the transmission efficiency of the micro-hole 141 on the electromagnetic wave, and reduce the loss of the electromagnetic wave.

For example, in the antenna structure provided by an example of the present embodiment, the micro-hole can be filled with an insulating material, so as to increase the sealing performance of the antenna structure, and prevent foreign matters entering the micro-hole and affecting the performance of the antenna structure. Certainly, the embodiments of the present disclosure include but are not limited thereto, and micro-hole can be not filled with an insulating material.

For example, in the antenna structure provided by an example of the present embodiment, the insulating material can be dimethyl silicone polymer. Since the blocking of the dimethyl silicone polymer on the electromagnetic wave is relatively small, the transmission of the electromagnetic wave of the antenna structure will not be affected.

For example, in the antenna structure provided by an example of the present embodiment, the thickness of the first base substrate is in a range of 1 to 10 μm.

For example, in the antenna structure provided by an example of the present embodiment, the thickness of the second base substrate is in a range of 1 to 10 μm.

For example, in the antenna structure provided by an example of the present embodiment, the aperture of the micro-hole is in a range of 0.1 to 3 μm.

Second Embodiment

On the basis of the first embodiment, the present embodiment provides an antenna structure. Different from the first embodiment, the first base substrate and the second base substrate can be flexible substrates in the antenna structure provided by the present embodiment. In this way, the antenna structure provided by the present embodiment can be applied to a flexible electronic device such as a wearable electronic device. Besides, because the antenna structure provided by the present embodiment can be curved and even curved into a ring shape, the range and directions of releasing or receiving electromagnetic wave of the antenna structure can be further improved.

For example, in the antenna structure provided by an example of the present embodiment, as illustrated by FIG. 1, the antenna structure further includes barriers 180 disposed between the first base substrate 110 and the second base substrate 120. The barriers 180 are located in a region between the adjacent second electrodes 125. In a case where the dielectric layer is a flowable dielectric layer, for example, liquid crystal, the barriers 180 located in the region between the adjacent second electrodes 125 can prevent the dielectric layer located between the adjacent second electrodes 125 flowing when the antenna structure is curved or bent, so as to avoid the uneven thickness of the dielectric layer between the adjacent second electrodes 125, and improve the stability of the antenna structure. It is noted that, in a case where the first base substrate and the second base substrate of the antenna structure are not flexible substrates, the abovementioned barriers can also be provided. It is noted that, the dielectric layer, the first electrode, and the second electrode which are between the two adjacent barriers can constitute a resonant cavity unit.

For example, in the antenna structure provided by an example of the present embodiment, as illustrated by FIG. 1, the barriers 180 and the first electrodes 115 are in one-to-one correspondence. In this way, the barriers 180 can further play a role of supporting the first electrodes 115, so as to prevent the first electrodes 115 shifting.

For example, in the antenna structure provided by an example of the present embodiment, as illustrated by FIG. 1, two ends of the barrier wall 180 contact the first base substrate 110 and the second base substrate 120 respectively, so as to isolate the dielectric layer between the adjacent barriers 180 from the dielectric layer at the other positions, so as to further prevent the dielectric layer between the adjacent second electrodes 125 flowing upon the antenna structure being curved or bent, and avoid the uneven thickness of the dielectric layer of a single resonant cavity unit under an external force, so as to improve the stability of the antenna structure. Certainly, the embodiments of the present disclosure include but are not limited thereto, the two ends of the barrier wall can only contact one of the first base substrate and the second base substrate, i.e., the barrier wall can be disposed on the first base substrate and extends towards the second base substrate, or, the barrier wall can be disposed on the second base substrate and extends towards the first base substrate, as long as the barrier wall can play a certain role of prevent the dielectric layer between the adjacent second electrodes flowing when the antenna structure is curved or bent. Besides, the specific size of the barrier wall can be determined according to the characteristics of the dielectric layer.

Figure 3:
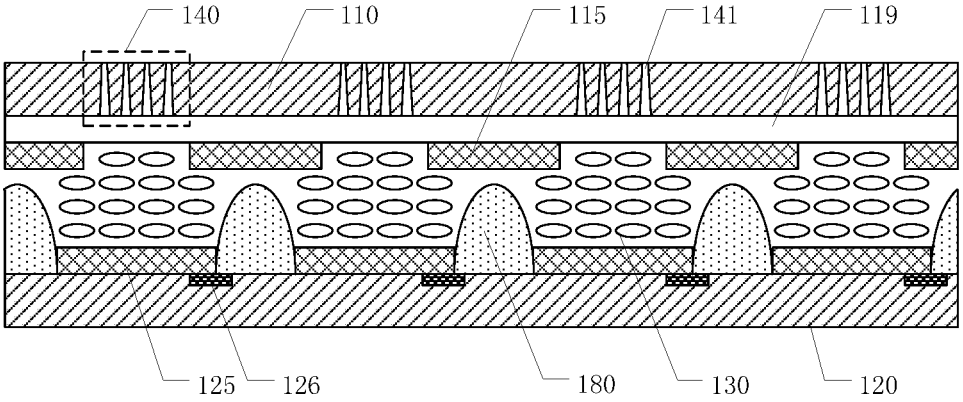
FIG. 3 is a structural schematic diagram of another antenna structure provided by an embodiment of the present disclosure.

For example, FIG. 3 illustrates another structural schematic diagram of an antenna structure provided by the present embodiment. As illustrated by FIG. 3, in the antenna structure, the barrier wall 180 is disposed on the second base substrate 120 and extends towards to the first base substrate 110.

For example, the material of the barrier wall can be selected as a material whose viscosity is larger than 1000 Pa·s. In this way, the adhesive force between the barrier wall and the first base substrate or the second base substrate can be improved.

For example, the material of the barrier wall can be selected as a material whose elasticity modules is less than 72000 mpa. In this way, the ability of the liquid crystal antenna to buffer an external force can be improved.

For example, the material of the barrier wall includes dimethyl silicone polymer. Since dimethyl silicone polymer not only has a relatively low elasticity modules and relatively high viscosity, but also has relatively weak blocking to the electromagnetic wave, the transmission of electromagnetic wave in the antenna structure will be not affected.

Third Embodiment

Figure 4:
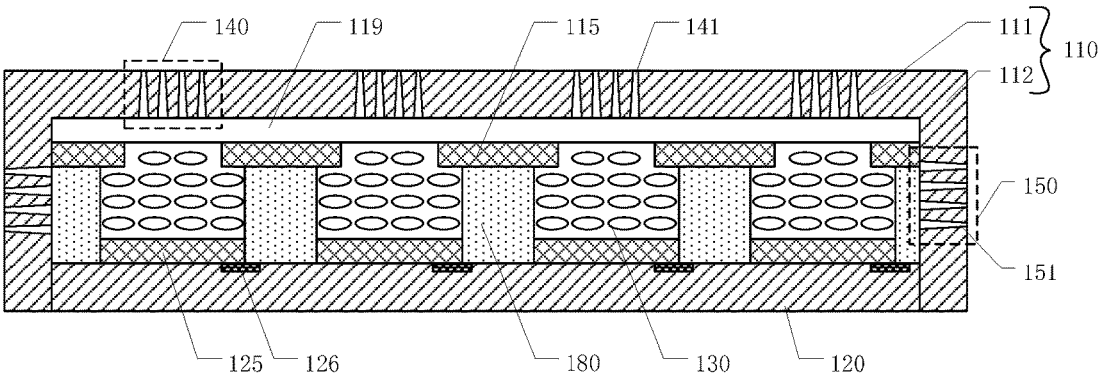
FIG. 4 is a structural schematic diagram of another antenna structure provided by an embodiment of the present disclosure.

On the basis of the first embodiment, the present embodiment provides an antenna structure. FIG. 4 illustrates a structural schematic diagram of an antenna structure according to the present embodiment. As illustrated by FIG. 4, the first base substrate 110 includes a body portion 111 and a frame portion 112. The body portion 111 and the second base substrate 120 are disposed in parallel, i.e., the body portion 111 and the second base substrate 120 are approximately parallel to each other; the frame portion 112 is disposed at the edges of the body portion 111 and extends towards and contacts the second base substrate 120. The frame portion 112 includes a second micro-hole unit 150, each of the second micro-hole unit 150 includes at least one micro-hole 151 running through the frame portion 112. It is noted that, the abovementioned plurality of first micro-hole units 140 are disposed on the body portion 111 of the first base substrate 110.

In the antenna structure provided by the present embodiment, the first base substrate not only includes a body portion which is approximately parallel to the second base substrate, but also includes a frame portion disposed at edges of the body portion and extending towards and contacts the second base substrate. In this way, the first base substrate can provide certain encapsulation to the dielectric layer disposed between the first base substrate and the second base substrate, so as to improve the stability of the antenna structure. Besides, the frame portion is further provided with the second micro-hole unit, which can improve the ability of the antenna structure to receive or transmit the electromagnetic wave in a side surface direction.

For example, as illustrated by FIG. 4, the frame portion 112 can contact a side surface of the second base substrate 120, and partially encapsulate the second base substrate 120. Certainly, the embodiments of the present disclosure include but are not limited thereto, the frame portion can contact a surface of the second base substrate facing to the body portion.

For example, as illustrated by FIG. 4, the frame portion 112 extends along a direction perpendicular to the second base substrate 120. Certainly, the embodiments of the present disclosure include but are not limited thereto, the frame portion can extend towards the second base substrate along other directions, for example, the frame portion can extend towards the second base substrate along a curved line or a folded line.

Fourth Embodiment

Figure 5:
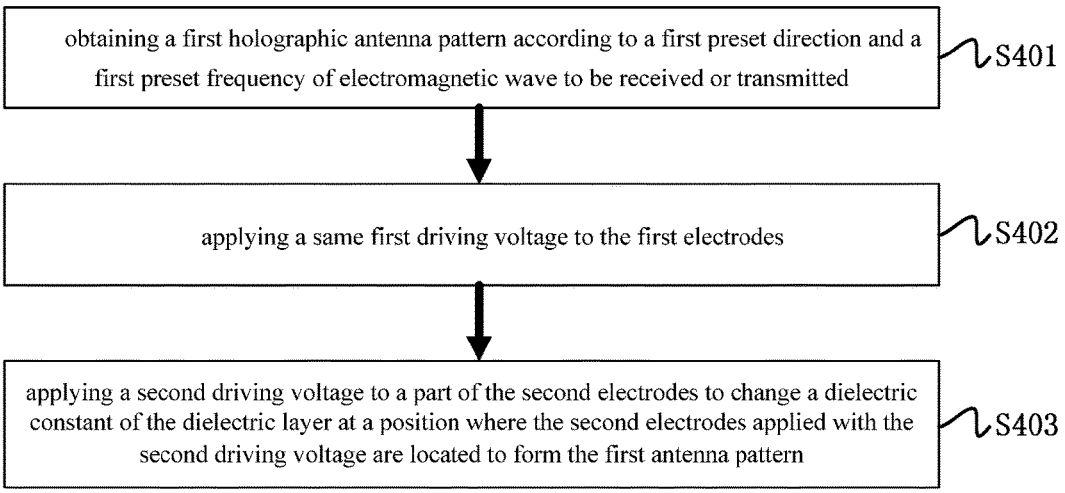
FIG. 5 is a flow diagram of a driving method of an antenna structure provided by an embodiment of the present disclosure.

The present embodiment provides a driving method of an antenna structure. The antenna structure can be any one of the antenna structures according to the first embodiment to the third embodiment. FIG. 5 is a flow diagram of a driving method of an antenna structure provided by the present embodiment. As illustrated by FIG. 5, the driving method includes the steps S401-S403.

Step S401: obtaining a first holographic antenna pattern according to a first preset direction and a first preset frequency band of an electromagnetic wave to be received or transmitted.

For example, the corresponding first holographic antenna pattern can be calculated according to the first preset direction and the first preset frequency band of the electromagnetic wave to be received or transmitted.

Step S402: applying a same first driving voltage to the first electrodes.

Step S403: applying a second driving voltage to a part of the second electrodes to change a dielectric constant of the dielectric layer at a position where the second electrodes applied with the second driving voltage are located to form the first antenna pattern.

In the driving method of an antenna structure provided by the present embodiment, the corresponding first holographic antenna pattern can be acquired according to the first preset direction and the first preset frequency band of the electromagnetic wave to be received or transmitted; then, applying a second driving voltage to a part of the second electrodes; at this time, the antenna structure (including a second electrode, adjacent first electrodes and the dielectric layer between the second electrode and the first electrodes) at every position where the second electrode applied with the second driving voltage can be regarded as a resonant cavity unit, i.e., an antenna unit which can independently transmit electromagnetic wave. In this way, the plurality of resonant cavity units or antenna units which form the abovementioned first holographic antenna pattern can receive or transmit electromagnetic wave with a first frequency band in a first preset direction, according to the constructive and destructive interference principle. It is noted that, when it is required to receive or transmit electromagnetic wave of the same frequency band or different frequency band in another direction, re-obtaining a holographic antenna pattern to realize receive or transmit electromagnetic wave of the same frequency band or different frequency band in the other direction.

For example, the driving method of an antenna structure provided by an example further include: obtaining a second holographic antenna pattern according to a second preset direction and a second preset frequency of the electromagnetic wave to be received or transmitted; stop applying the second driving voltage; and applying a third driving voltage to a part of the second electrodes to change the dielectric constant of the dielectric layer at a position where the second electrodes applied with the third driving voltage are located to form the second antenna pattern. At this time, the plurality of resonant cavity units or antenna units forming the abovementioned second holographic antenna pattern can receive or transmit electromagnetic wave with the second frequency band in the second preset direction, according to the constructive and destructive interference principle. In this way, the driving method can realize switching from receiving or transmitting electromagnetic wave with a first preset frequency band in a first preset direction to receiving or transmitting electromagnetic wave with a second preset frequency band in a second preset direction.

Figure 6:
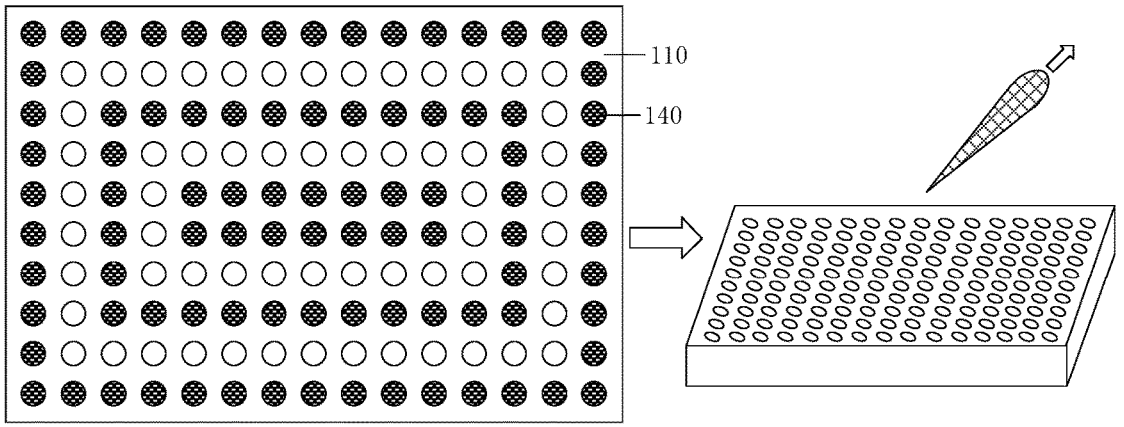
FIG. 6 is an operating schematic diagram of an antenna structure provided by an embodiment of the present disclosure.

For example, as illustrated by FIG. 6, applying a second driving voltage to a part of the second electrodes to form a first holographic antenna pattern. In this case, the first micro-hole units 140 on the first base substrate 110 present a first holographic antenna pattern. Receiving or transmission of the electromagnetic wave with the first preset frequency band in the first preset direction is realized through the antenna structure.

Figure 7:
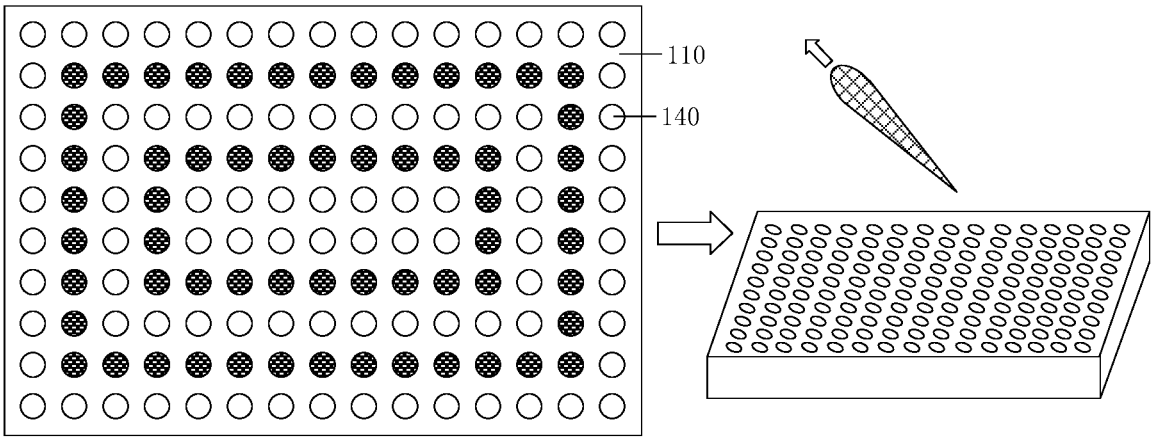
FIG. 7 is an operating schematic diagram of another antenna structure provided by an embodiment of the present disclosure.

For example, as illustrated by FIG. 7, applying a third driving voltage to another part of the second electrodes to form a second holographic antenna pattern; in this case, the first micro-hole units 140 on the first base substrate 110 present a second holographic antenna pattern. Receiving or transmission of the electromagnetic wave with the second preset frequency band in the second preset direction is realized through the antenna structure.

For example, in the driving method of the antenna structure provided by an example of the present embodiment, the first driving voltage is a driving voltage with low frequency, the second driving voltage and the third driving voltage are driving voltages with high frequency. Thus, when the dielectric layer is dual-frequency liquid crystal, the response speed of the antenna structure can be improved, and the switching speed of antenna structure switching from receiving or transmitting electromagnetic wave with the first preset frequency band in the first preset direction to receiving or transmitting electromagnetic wave with the second preset frequency band in the second preset direction can be improved.

For example, the driving method of an antenna structure provided by an example of the present embodiment further includes: before obtaining the first holographic antenna pattern, dividing the antenna structure into a plurality of antenna regions; the respective antenna regions can independently load holographic antenna patterns. In this way, different antenna regions can form different holographic antenna patterns. Thus, the antenna structure can simultaneously receive or transmit electromagnetic wave of different frequency bands or the same frequency band in different directions.

Figure 8:
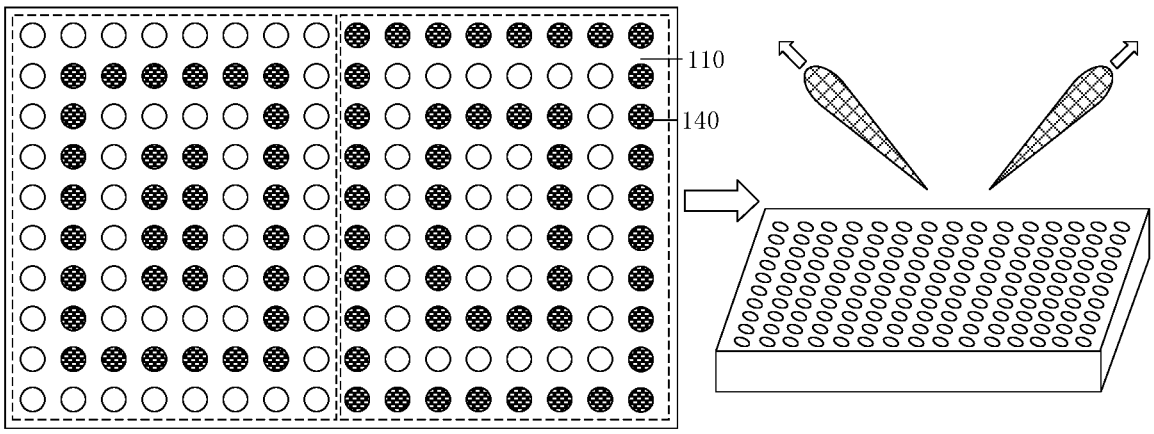
FIG. 8 is an operating schematic diagram of another antenna structure provided by an embodiment of the present disclosure.

For example, as illustrated by FIG. 8, the antenna structure is divided into a first antenna region 201 and a second antenna region 202; the first antenna region 201 forms a third holographic antenna pattern, and the second antenna region forms a fourth holographic antenna pattern. In this way, Receiving or transmission of the electromagnetic wave with the third preset frequency band in the third preset direction is realized through the first antenna region; receiving or transmission of the electromagnetic wave with the fourth preset frequency band in the fourth preset direction is realized through the second antenna region. The example illustrated by FIG. 8 includes two antenna regions, the embodiments of the present disclosure include but are not limited thereto, and the antenna structure can be divided into more antenna regions, so as to realize simultaneously receive or transmit electromagnetic wave of different frequency bands or the same frequency band in various directions.

It is noted that, the first holographic antenna pattern, the second holographic antenna pattern, the third holographic antenna pattern, and the fourth holographic antenna pattern illustrated in FIGS. 6 to 8 only serve as examples for description. The specific holographic antenna patterns can be calculated according to practical situations.

Fifth Embodiment

Figure 9:
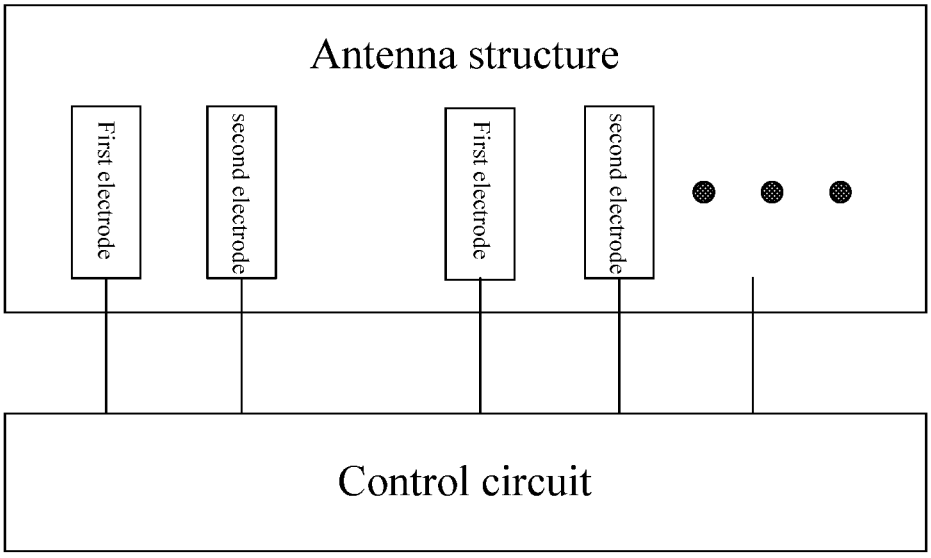
FIG. 9 is an operating schematic diagram of an antenna system provided by an embodiment of the present disclosure.

The present embodiment provides an antenna system. FIG. 9 illustrates a schematic diagram of an antenna system according to the present embodiment. As illustrated by FIG. 9, the antenna system includes an antenna structure and a control circuit. The antenna structure can be the antenna structure according to any one of the first embodiment to the third embodiment. The control circuit is electrically connected with the plurality of first electrodes and the plurality of second electrodes to control the antenna structure.

Figure 10:
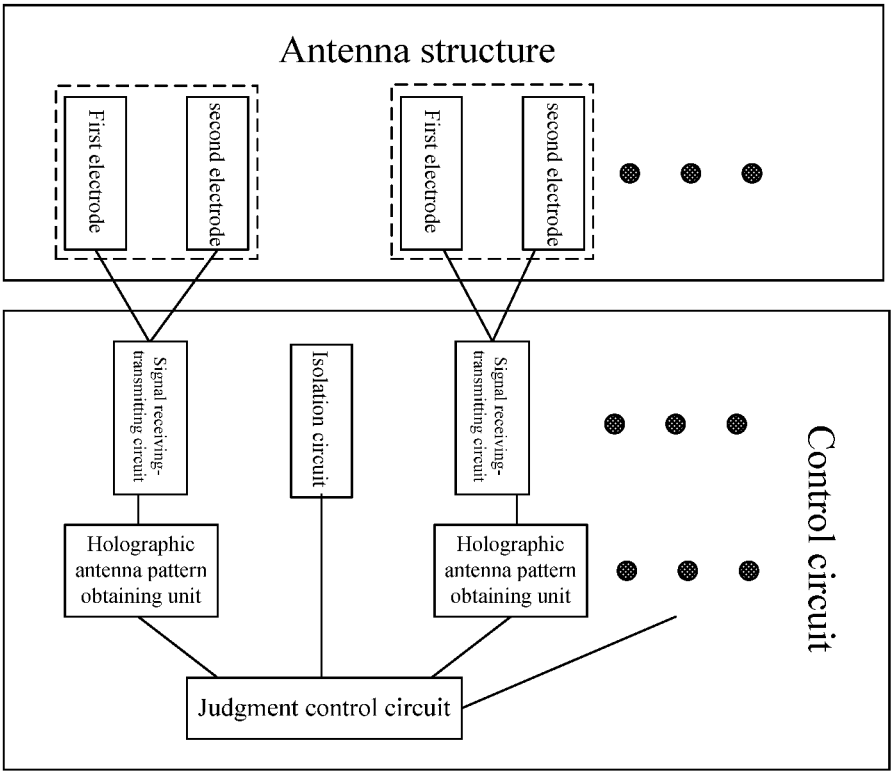
FIG. 10 is an operating schematic diagram of another antenna system provided by an embodiment of the present disclosure.

For example, in the antenna system provided by an example of the present embodiment, the antenna structure includes a plurality of antenna regions, as illustrated by FIG. 10, the control circuit can include: a plurality of signal receiving-transmitting circuits, electrically connected with the first electrodes and the second electrodes in the plurality of antenna regions respectively; and a plurality of holographic antenna pattern obtaining units, electrically connected with the signal receiving-transmitting circuits respectively. In this way, different holographic antenna patterns can be respectively obtained by the plurality of holographic antenna pattern obtaining units, and different holographic antenna patterns can be loaded to the different antenna regions through the different signal receiving-transmitting circuits, so as to realize simultaneously receive or transmit electromagnetic wave of different frequency bands or the same frequency band in different directions. The details can refer to the description relevant to FIG. 8 in the fourth embodiment, and the repeated portions are omitted herein. It is noted that, the abovementioned plurality of holographic antenna obtaining units can function together, so as to acquire one holographic antenna pattern, so as to load one holographic antenna pattern on the plurality of antenna regions, so as to receive or transmit electromagnetic wave in one direction.

For example, in the antenna system provided by an example of the present embodiment, as illustrated by FIG. 10, the control circuit further includes an isolation circuit, disposed between the plurality of signal receiving-transmitting circuits, configured to isolate the plurality of signal receiving-transmitting circuits from each other, so as to prevent crosstalk between the plurality of signal receiving-transmitting circuits.

For example, in the antenna structure provided by an example of the present embodiment, as illustrated by FIG. 10, the control circuit can further include a judgment circuit, electrically connected with the plurality of holographic antenna pattern calculation units. In this way, the judgment control circuit can judge whether or not to simultaneously receive or transmit electromagnetic wave in different directions. If it is required to simultaneously receive or transmit electromagnetic wave in different directions, the judgment control circuit can send a signal to make the holographic antenna pattern calculation units respectively acquire different holographic antenna patterns; if it is required to receive or transmit electromagnetic wave in only one direction, the judgment control circuit can send a signal to make the holographic antenna pattern calculation units to together acquire a holographic antenna pattern.

Figure 11:
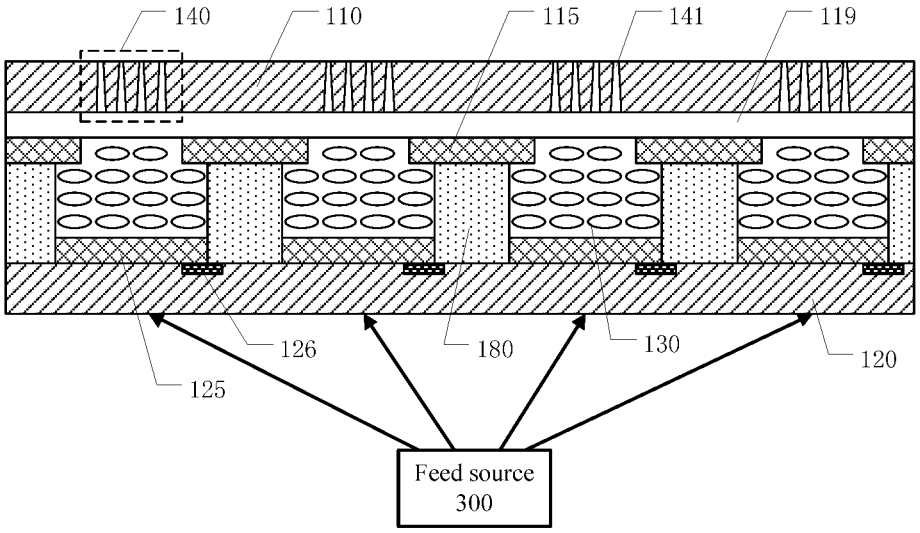
FIG. 11 is an operating schematic diagram of another antenna system provided by an embodiment of the present disclosure.

For example, in the antenna system provided by an example of the present embodiment, as illustrated by FIG. 11, the antenna system further includes a feed source 300, disposed at a side of the second base substrate 120 away from the first base substrate 110. Certainly, the embodiments of the present disclosure include but are not limited thereto, and the feed source can be disposed at a side of the first base substrate away from the second base substrate.

The following points should be noted:

(1) The accompanying drawings of the embodiments of the present disclosure only involve the structures relevant to the embodiments of the present disclosure, and other structures may refer to the prior art.

(2) The technical features in the same embodiment and different embodiments may be mutually combined without conflict.

The foregoing is only the preferred embodiments of the present disclosure and not intended to limit the scope of protection of the present disclosure. The scope of protection of the present disclosure should be defined by the appended claims.

The invention claimed is:

1. An antenna structure, comprising:

a first base substrate;

a second base substrate;

a dielectric layer, disposed between the first base substrate and the second base substrate;

a plurality of first electrodes, disposed apart at a side of the first base substrate facing to the dielectric layer; and a plurality of second electrodes, disposed apart at a side of the second base substrate facing to the dielectric layer, wherein the first base substrate comprises a plurality of first micro-hole units, each of the first micro-hole units is located in a region between the adjacent first electrodes, and each of the first micro-hole units comprises at least one micro-hole extending along a direction perpendicular to the first base substrate.

2. The antenna structure according to claim 1, wherein the second electrodes and the first micro-hole units are in one-to-one correspondence, the first micro-hole units are disposed in an array on the first base substrate.

3. The antenna structure according to claim 1, wherein the micro-hole runs through the first base substrate.

4. The antenna structure according to claim 1, wherein orthographic projections of the first electrodes on the first base substrate and orthographic projections of the second electrodes on the first base substrate are alternately disposed.

5. The antenna structure according to claim 1, wherein the first base substrate comprises:

a body portion, disposed parallel to the second base substrate; and an extending portion, disposed at an edge of the body portion, extending towards the second base substrate and contacting the second base substrate, wherein the extending portion comprises a second micro-hole unit, each of the second micro-hole unit comprises at least one micro-hole running through the extending portion.

6. The antenna structure according to claim 1, further comprising:

a control electrode, disposed between the plurality of first electrodes and the first base substrate, wherein the at least one micro-hole contact the control electrode.

7. The antenna structure according to claim 1, wherein the dielectric layer comprises liquid crystal.

8. The antenna structure according to claim 7, wherein the liquid crystal comprises a dual-frequency liquid crystal material.

9. The antenna structure according to claim 1, further comprising:

barriers, disposed between the first base substrate and the second base substrate and located in a region between the adjacent second electrodes.

10. The antenna structure according to claim 9, wherein the barriers and the first electrodes are in one-to-one correspondence.

11. A driving method of an antenna structure, wherein the antenna structure comprises the antenna structure according to claim 1, the driving method comprises:

obtaining a first holographic antenna pattern according to a first preset direction and a first preset frequency of an electromagnetic wave to be received or transmitted;

applying a same first driving voltage to the first electrodes; and applying a second driving voltage to a part of the second electrodes to change a dielectric constant of the dielectric layer at a position where the second electrodes applied with the second driving voltage are located to form the first antenna pattern.

12. The driving method of an antenna structure according to claim 11, further comprising:

obtaining a second holographic antenna pattern according to a second preset direction and a second preset frequency of the electromagnetic wave to be received or transmitted;

stop applying the second driving voltage; and applying a third driving voltage to a part of the second electrodes to change a dielectric constant of the dielectric layer at a position where the second electrodes applied with the second driving voltage are located to form the second antenna pattern.

13. The driving method of an antenna structure according to claim 11, wherein the first driving voltage comprises a driving voltage with low frequency, the second driving voltage and the third driving voltage are driving voltages with high frequency.

14. An antenna system, comprising:

the antenna structure according to claim 1.

15. The antenna system according to claim 14, further comprising:

a control circuit, electrically connected with the first electrodes and the second electrodes to control the antenna structure, wherein the antenna structure comprises a plurality of antenna regions, the control circuit comprises:

a plurality of signal receiving-transmitting circuits, connected with the first electrodes and the second electrodes in the plurality of antenna regions respectively; and a plurality of holographic antenna pattern calculation units, connected with the plurality of signal receiving-transmitting circuits respectively.

16. The antenna structure according to claim 2, wherein the first base substrate comprises:

a body portion, disposed parallel to the second base substrate; and an extending portion, disposed at an edge of the body portion, extending towards the second base substrate and contacting the second base substrate, wherein the extending portion comprises a second micro-hole unit, each of the second micro-hole unit comprises at least one micro-hole running through the extending portion.

17. The antenna structure according to claim 2, further comprising:

a control electrode, disposed between the plurality of first electrodes and the first base substrate and covering an entire surface of the first base substrate, wherein the first micro-hole units contact the control electrode.

18. The antenna structure according to claim 2, wherein the dielectric layer comprises liquid crystal.

19. The antenna structure according to claim 18, wherein the liquid crystal comprises a dual-frequency liquid crystal material.

20. The antenna structure according to claim 2, further comprising:

barriers, disposed between the first base substrate and the second base substrate and located in a region between the adjacent second electrodes.

* * * * *